US012791267B2

(12) United States Patent
Marakkos et al.

(10) Patent No.: US 12,791,267 B2
(45) Date of Patent: Nov. 10, 2026

(54) METHOD FOR AMPLIFYING THE EXERGY OF THERMOCLINES

(71) Applicant: The Cyprus Institute, Nicosia (CY)

(72) Inventors: Konstantinos Marakkos, Nicosia (CY); Costas Papanicolas, Nicosia (CY)

(73) Assignee: The Cyprus Institute, Nicosia (CY)

( * ) Notice: Subject to any disclaimer, the term of this patent is extended or adjusted under 35 U.S.C. 154(b) by 215 days.

(21) Appl. No.: 18/692,376

(22) PCT Filed: Sep. 15, 2022

(86) PCT No.: PCT/IB2022/058713
§ 371 (c)(1),
(2) Date: Mar. 15, 2024

(87) PCT Pub. No.: WO2023/042116
PCT Pub. Date: Mar. 23, 2023

(65) Prior Publication Data

US 2024/0384948 A1 Nov. 21, 2024

(30) Foreign Application Priority Data

Sep. 16, 2021 (EP) ..... 21197009

(51) Int. Cl.
*F28F 21/04* (2006.01)
*F28F 21/08* (2006.01)

(52) U.S. Cl.
CPC ..... *F28F 21/04* (2013.01); *F28F 21/083* (2013.01); *F28F 2280/00* (2013.01)

(58) Field of Classification Search
CPC ..... F28F 21/04; F28F 21/083; F28F 2280/00; Y02E 60/14; F28D 20/0039;
(Continued)

(56) References Cited

U.S. PATENT DOCUMENTS 4,479,352 A * 10/1984 Yamaoka ..... F01K 3/004 60/659
4,501,262 A * 2/1985 Lyon ..... F24D 17/0021 126/640
(Continued)

FOREIGN PATENT DOCUMENTS

CN 104595137 A * 5/2015 ..... F03G 7/05
CN 106288903 A * 1/2017 ..... F28D 20/0034
(Continued)

OTHER PUBLICATIONS

International Search Report for PCT/IB2022/058713, dated Mar. 23, 2023, 4 pages.
(Continued)

*Primary Examiner* — Jenna M Maroney
*Assistant Examiner* — Gustavo A Hincapie Serna
(74) *Attorney, Agent, or Firm* — Stinson LLP

(57) ABSTRACT

The present invention describes a method for enhancing the exergy level of a Thermal Energy Storage (TES) single-tank unit to a level that is nearly equal to that of a two-tank (hot and cold tank) TES system. The present method applies to single-tank TES and may be used in domestic hot-water cylinders, solar water heaters, buffer tanks for hot or chilled fluid storage or in Concentrated Solar Power (CSP) plants. It can be applied at the manufacturing stage of the TES or, while in operation.

13 Claims, 7 Drawing Sheets

(58) Field of Classification Search
CPC ..... F28D 2020/0047; F28D 2020/0095; F28D 21/00; F24H 1/18; F24H 7/00; F24D 3/1016
USPC ..... 165/173
See application file for complete search history.

(56) References Cited

U.S. PATENT DOCUMENTS

| | | | | |
|---|---|---|---|---|
| 4,523,629 | A * | 6/1985 | Copeland | F28D 20/0039 165/104.19 |
| 6,907,923 | B2 * | 6/2005 | Sienel | F28D 20/0039 60/659 |
| 7,458,418 | B2 * | 12/2008 | Sienel | F28D 20/0039 165/104.19 |
| 9,234,530 | B1 * | 1/2016 | Sneddon | F28D 15/00 |
| 9,841,243 | B2 * | 12/2017 | Oliva Llena | F28D 20/023 |
| 10,012,448 | B2 * | 7/2018 | Laughlin | F28D 15/00 |
| 10,378,830 | B2 * | 8/2019 | Schierack | F28D 20/0039 |
| 10,809,014 | B1 * | 10/2020 | Harpole | F28D 20/0034 |
| 11,053,847 | B2 * | 7/2021 | Apte | F28D 20/0056 |
| 11,359,823 | B2 * | 6/2022 | Zhang | F24H 15/219 |
| 11,662,157 | B1 * | 5/2023 | Kucic | F28D 20/0039 220/565 |
| 11,852,043 | B2 * | 12/2023 | Bollinger | F01K 3/006 |
| 2005/0167092 | A1 * | 8/2005 | Comeaux | F24F 5/0017 165/219 |
| 2010/0290763 | A1 * | 11/2010 | Boulay | F24H 15/164 219/494 |
| 2011/0067690 | A1 | 3/2011 | Slocum et al. | |
| 2011/0168159 | A1 | 7/2011 | Lataperez et al. | |
| 2011/0283690 | A1 * | 11/2011 | Bollinger | F02C 6/16 60/327 |
| 2012/0067300 | A1 * | 3/2012 | Berrio | F24H 9/133 122/19.2 |
| 2021/0055061 | A1 * | 2/2021 | Han | F28D 20/0039 |
| 2022/0120514 | A1 * | 4/2022 | Spero | F24H 7/0233 |
| 2022/0373269 | A1 * | 11/2022 | Sherman | F28D 20/0043 |
| 2023/0220258 | A1 * | 7/2023 | Novek | F25J 1/0022 165/10 |

FOREIGN PATENT DOCUMENTS

| | | | | |
|---|---|---|---|---|
| DE | 2314960 | | 10/1973 | |
| DE | 2912785 | A1 | 10/1980 | |
| EP | 2141432 | A1 * | 1/2010 | F24D 11/00 |
| EP | 3832830 | A1 * | 6/2021 | F28D 20/0034 |
| EP | 4062049 | B1 * | 10/2023 | F03G 3/094 |
| GB | 2485950 | A * | 5/2012 | F24H 9/2021 |
| IT | 102010901803840 | A1 | 7/2011 | |
| WO | 2019025825 | A1 | 2/2019 | |

OTHER PUBLICATIONS

Written Opinion of the International Searching Authority for PCT/IB2022/058713, dated Mar. 23, 2023, 4 pages.

* cited by examiner

METHOD FOR AMPLIFYING THE EXERGY OF THERMOCLINES

TECHNICAL FIELD

The present invention relates to thermocline Thermal Energy Storage (TES) and, more specifically, to a method for enhancing the exergy of the single-tank TES unit to a level that is nearly equal to that of a two-tank TES system. The present method is applicable to a TES unit that is either at the manufacturing stage or already in use.

BACKGROUND

Thermal energy storage (TES) tanks are used for storing thermal energy, so that it can be dispatched on demand. TES systems have a wide use principally in domestic hot-water supply, process heat and Concentrated Solar Power (CSP) plants.

Currently, commercially available domestic hot-water systems feature a hot-water cylinder, while in the CSP industry, a two-tank system is preferred. A typical two storage tank system design comprises a tank for storing the hot fluid and a second one for cold fluid storage. A two-tank TES operation in a CSP system, typically involves pumping fluid from the cold storage tank to the CSP receiver, where it is heated and, thereafter, stored in the hot tank. The hot fluid is then sent to a heat exchanger, where heat is transferred to a thermal-to-electrical power block. The fluid is then returned to the cold tank at the cold temperature state. The two tank system ensures the highest possible level of exergy and, hence, the potential to produce electricity.

A single-tank TES system, on the other hand, comprises one tank containing a fluid having a thermal gradient in the vertical direction, with the hotter region (lower density) lying on the top side of the tank and the colder one (higher density) lying at the base side of the tank. Such a system has a lower capital cost, compared to the two-tank system, but, as a result of thermal diffusion from the hot to the cold fluid region, the exergy is destroyed, which in the case of CSP power plants implies a reduced potential to generate electrical power or, in the case of domestic hot water cylinders and buffer tanks for space heating or cooling, a reduced capacity to yield hot or chilled water.

An optimized device would be one having a single-tank storage tank allowing for maintaining the hot fluid at the maximum possible temperature level, that is, minimizing the diffusion of heat to the lower cold region.

Several existing patents or patent applications claim to achieve this goal via innovative designs.

For example, the US patent application US2011/0168159A1 claims a dual thermal energy storage tank comprising a barrier which floats at the interface of two masses of fluid stored at different temperatures, said barrier comprising a fluid-tight outer shell and a filler material, said filler material is made of rigid and compression resistant material.

The thermal barrier concept is also claimed in the patent application U.S. Pat. No. 4,523,629A. More specifically, the thermal barrier is conceived in the form of a raft with circumferential nodules that act as spacers for clearance and for keeping the raft centred in the tank during vertical translation.

An element or insulating septum used to thermally insulate the hot fluid from the colder mass in a TES tank is described in the Italian patent application ITBS20100013A1. According to it, the thermal insulating septum also compensates for the fluid thermal expansion, as it comprises a flexible bladder containing an inert thermally insulating gas. The septum is traversed via mechanical means, such as a lead screw and actuator, while circumferential bristles are used for septum centering. Another example is provided by the US patent application US2011/0067690A, which claims a solar energy receiver comprising a container having an interior adapted to contain a solar absorption material, said container including an insulated divider plate that provides a physical and thermal barrier between the thermally stratified hot and cold layers within the container.

The working principle of all these inventions is based on a divider plate that thermally insulates the hot fluid regime from the cold region.

Beyond the benefits provided, several disadvantages are associated with the plate concept. For example, since the plate has a diameter that is nearly as large as the internal diameter of the storage tank, the presence of ancillary hardware in the TES, such as a heat exchanger coil or back-up heater, that are usually included in a domestic hot-water cylinder, render the use of the divider plate very difficult to employ. In fact, the presence of these ancillary hardware units would restrict the divider plate motion range and, hence, the energy storage capacity.

To solve the problem, for example, the US patent application US2012/0067300A1, provides for a heating/cooling system operating on the basis of a split buffer tank comprising a separation disk, a guide bar adapted inside the split buffer tank to freely allow the separation disk to move up and down along the guide bar to make room for hot and warm fluid storage on opposite sides of the disk, and a secondary system, and hydraulic connections to interconnect the heat source provider and the secondary system to the split buffer tank. Hence, in this case, when applied to domestic hot-water cylinders, the ancillary hardware, as the heat source provider, are externally connected to the split buffer tank by hydraulic connections.

Furthermore, the divider plate requires conformity to clearance tolerances and additional components, as, for example, the guide bar or the lead screw and the actuator, to permit its vertical movement in the TES. These engineering considerations incur added cost. A clearance between the plate and tank according to U.S. Pat. No. 4,523,629A or ITBS20100013A1 and the use of circumferential nodules or bristles towards this purpose, also has the implication of heat diffusion through the induced clearance gap.

Another disadvantage of using the divider plate, for example, in CSP TES, is that if the installation of the divider plate is to be done on a system already in use, the entire system operation must be stopped. In addition, the upgrade works may require cumbersome and expensive engineering work to accommodate for the TES ancillary hardware (for example, sensors, transducers, heat exchangers). Therefore, the divider plate has to be placed "ab initio".

Another disadvantage of said prior art methods becomes apparent when examining the operational cycle of the divider plate in a CSP plant. Pumping fluid from the TES cold fluid region to the CSP receiver lowers the plate, until it reaches the backup electric heaters. A suitable plate support is thus required, such as in the form of support legs fitted beneath the plate. This contingency inevitably incurs some additional cost.

Even more unfavorable, there is a space that cannot be used effectively in the storage tank, resulting from the "dead" space between the rest position of the divider plate and the tank bottom. Hence apart from the added cost, there is a consequent reduction in storage capacity.

The "dead" energy storage space is also an issue for domestic hot water tanks that have a curved bottom, which is usually the case as this design provides a better structural integrity than a flat one.

Another issue regards the operating temperature levels achieved by said CSP plant designs. Usually, this temperature level is not greater than 600° C.

For example, in US2011/0168159A1, the proposed design and materials apply for TES using molten salt, in particular a mixture of molten nitrate salts by which the stored fluids work in a temperatures range of 300-400° C. In order to meet the desired density for the filler material of the barrier, carbon steel or stainless-steel materials are used. Moreover, for improving the performance of the outer shell of the divider plate with respect to thermal deformations, some circumferential waved stainless-steel lobes are implemented in the peripheral region of the barrier. However, the said patent reliance on steel also means that it cannot be used with molten halides, which are a cost-effective storage fluid for operating over 800° C.; in fact, steels exhibit a high corrosion rate in molten halide salts.

A different concept to the divider plate is stated in the German patent DE 2314960 A1 and comprises a layer of balls made from synthetic epoxy resin to reduce the thermal energy transfer from the hot region, more specifically, steam, to the colder fluid in the tank, namely, water for space heating. The layer of epoxy balls floats on the water surface, to block heat from diffusing to the colder water mass, but inevitably, the gaps between the spheres compromise the heat blocking effectiveness of the layer. Furthermore, synthetic resin is not suitable for CSP applications, which as previously stated operate over 300° C.

In order to overcome the formerly mentioned problems, a thermal energy storage tank according to the present invention and a method for using therein will be discussed in the description as follows.

SUMMARY

The present invention aims to maximize the energy storage capacity of single-tank Thermal Energy Storage (TES), while delivering the exergy levels of a two-tank storage system, without suffering from the aforementioned shortcomings and limitations of the divider plate or split buffer tank.

According to an embodiment of the present invention, the claimed method utilizes a matrix made by a plurality of overlapping elements having at least one flat face, like plates or wafers, which form a thermally insulating layer, suspended at the interface between the cold and the hot fluid regions of the thermal energy tank. In other words, the matrix of floating plates/wafers remain suspended between the hot and cold regions of the fluid, since the density of said floating elements is intermediate to that of the hot and cold fluid regimes. The flat face of these elements permits overlapping and sealing the gaps between the elements, thereby, providing a better heat blocking effect than shapes that do not feature a flat face, e.g. spherical or oval pellets.

According to another aspect of the present method, the concept of using a matrix of floating plates/wafers, each of them having a diameter or size considerably smaller than the TES diameter, instead of a single divider plate, bypasses the need for linear motion guides, comprising, for example, guide bars or collars. As said floating layers consisting of a plurality of overlapping elements can shift laterally, while allowing for a certain degree of lateral compression, clearance tolerance is not required during axial translation, as in the case of the divider plate. Since said floating elements maintain contact with the tank inner wall during the translation, a better seal against heat diffusion than in the case of the divider plate (with a clearance gap), is achieved.

According to another aspect, the present method for enhancing the storage capacity of single tank TES does not require a plate support and, hence, does not suffer from the "dead" energy storage volume of the divider plate. This is particularly advantageous in the case of a curved tank bottom: in fact, once all the cold fluid has been heated to fill the hotter region, the floating elements will simply reside along the TES bottom and any gap will be formed between the matrix insulating suspension and the bottom tank structure, as in the case of the divider plate.

According to a further aspect, the present invention is applicable also in TES that includes inserts, like for example sensors, transducers heat exchangers and many others inserts of complicated shape. As is often a common situation in the case of domestic hot water and concentrated solar energy (CSP) TES boilers, internal heat exchangers or HX (typically a coil-HX) or electric backup heaters are used. More specifically, the floating elements will sink beneath the heat source in the presence of rising (lower density) hot fluid from the coil or heater.

According to another important aspect of the present invention, the method of generating a thermally insulating suspension by deploying a matrix of floating flat elements or plates/wafers that are considerably smaller than the TES diameter provides immunity to material thermal stress. In fact, each floating element in the overlapping layers of the matrix is free to shift with respect to one another, while the outer compressible thermal insulation layer of each floating element prevents the built-up of thermal stresses or the so-called thermal ratcheting that can occur during the expansion (heating) and contraction (cooling) of the TES tank walls.

Not least the fact that said floating element size can be adapted for being installed through a TES port hole, therefore the present method is appliable to a TES which is already in operation, and, for example, it is not required for the suspension matrix of floating elements to be installed during the TES manufacturing stage.

In addition, the divider o partition plate adopted in CSP TES allows for a maximum operating temperature of 450 up to 600° C. The reason lies in the fact that CSP TES implements molten salt to enhance the temperature of the hotter fluid. In this case stainless steel is used as one of the building materials which, while having acceptable corrosion compatibility with the nitrate salts working temperature (maximum 600° C.), would corrode rapidly at higher temperatures, especially at a temperature around 800° C., which is reached with molten chlorides, which are the cost-effective energy storage salt type used currently for a temperature of over 600°.

The present invention, on the other hand, incorporates recent advances in material technology to allow its application to higher temperatures, for example about 1000° C. (in molten chlorides).

For CSP-driven power generation, the present concept therefore allows a relatively higher thermal-electrical efficiency. To exemplify the characteristics and advantages of the present invention a series of figures are reported below.

SHORT DESCRIPTION OF THE DRAWINGS

The figures given herein provide an embodiment and the gist of the invention. Any variations are intended to be within and not as a departure from the scope of the invention.

FIG. 2(*b*) is an illustration of the wafer matrix function to sink beneath the heat source in the presence of a rising plume of heated fluid according to an embodiment of the present method.

FIG. 2(*c*) is a cross-sectional view of a horizontal domestic hot-water cylinder, further highlighting the floating element's ability to sink beneath the heat source (for example the back-up electric heater and coil) according to an embodiment of the present method.

FIG. 3(*b*) is a simulated temperature field in a solar water heater tank that does not use the present method, after 3 hours of solar-thermal charging.

FIG. 3(*c*) shows the calculated absorbed thermal power of the solar water heater with and without the use of the present method.

FIG. 5(*b*) is a side-view of the floating element design for use in molten chlorides.

Figure 6:
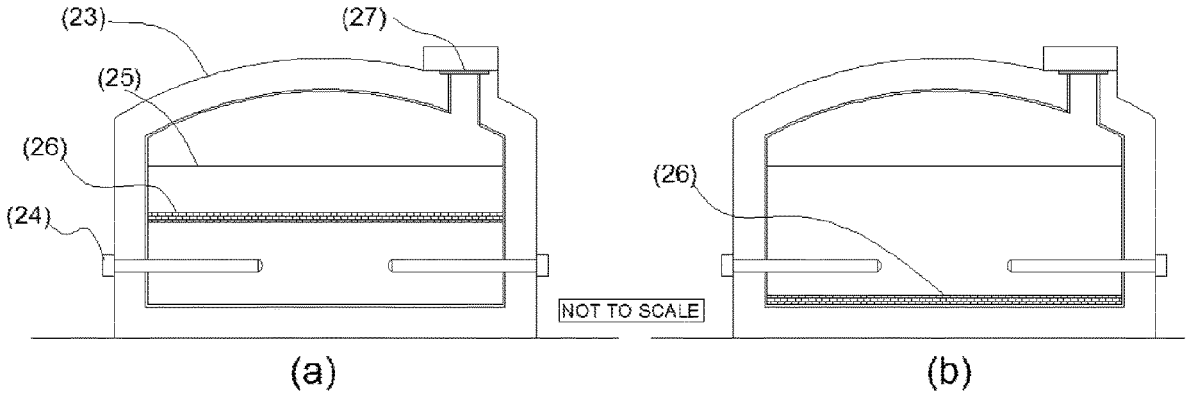

FIGS. 6(*a*) and 6(*b*) are typical cross-sectional views of a CSP TES utilising the floating elements matrix, according to an embodiment of the present method. The schematics exemplify the function of the matrix system to avoid the "dead" volume that results from the use of the divider plate concept.

Figure 7:
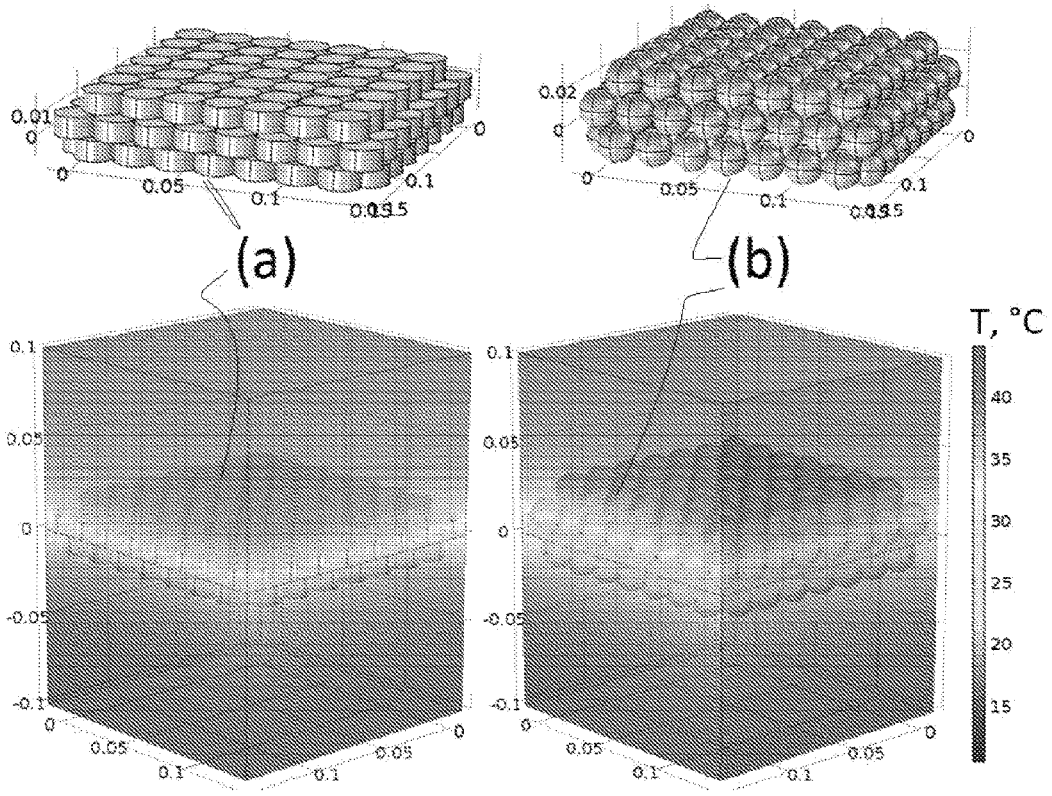

FIG. 7 is evidence of the relatively better heat blocking effect of the present invention of using a plurality of elements that feature at least a flat face as opposed to the concept of using elements having only curved surfaces such as balls.

Figure 8:
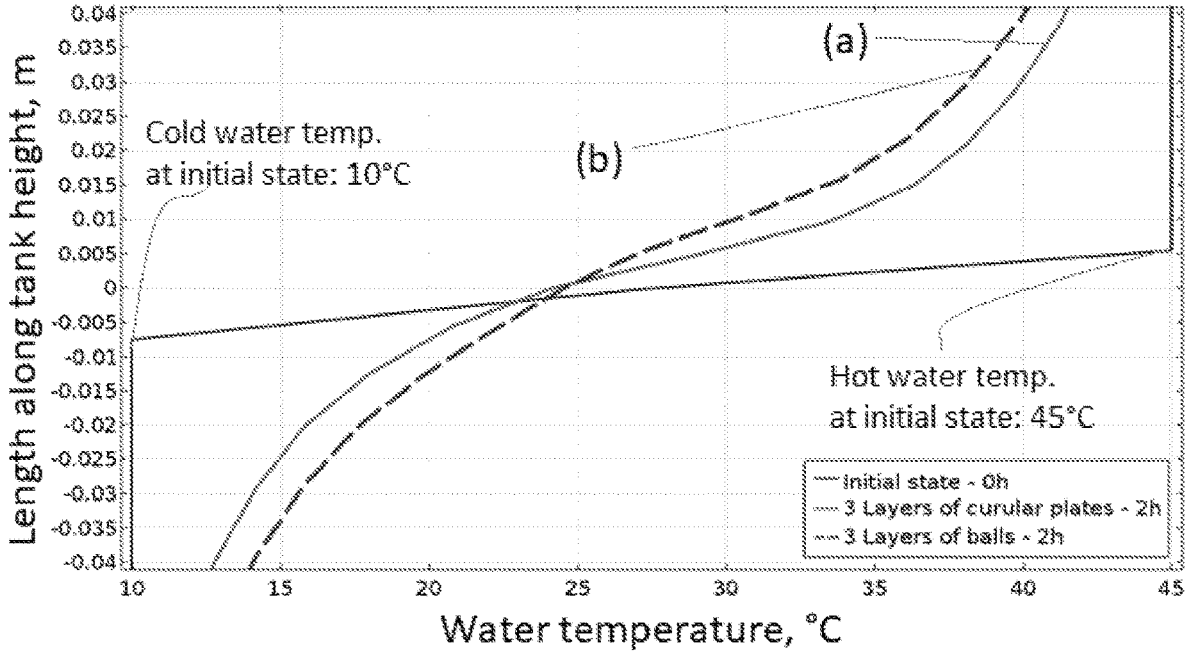

FIG. 8 is an axial water temperature profile in a tank having initially a hot water mass at 45° C. and a cold mass at 10° C., while (a) is the profile that results 2 hours after, when using circular wafers to block heat diffusion from the hot to the cold mass and (b) is the corresponding profile that results from using balls as the heat blocking matrix.

DETAILED DESCRIPTION

The following discussion is presented to enable a person skilled in the art to make and use the invention. Various modifications to the embodiments will be readily apparent to those skilled in the art, without departing from the scope of the present invention as claimed. Thus, the present invention is not intended to be limited to the embodiments described therein, but it must be accorded the widest scope consistent with the principles and features disclosed herein and defined in the appended claims.

The invention described herein is based on the method of using a matrix made by a plurality of overlapping floating elements, said floating elements having at least one flat face, such as plates or wafers, that form a thermally insulating suspension, having a density intermediate to that of the hot and cold fluid regime of a TES, for both domestic hot water and concentrated solar energy (CSP) applications. The flat face and the element overlapping features permit sealing of any gaps in between the elements, thereby, minimizing heat diffusion compared to three-dimensional shapes that do not feature at least one flat face or consist of a layer of elements.

Said plates or wafers, which form said plurality of overlapping floating elements of the suspension matrix, may have different size and shape, said shape comprising circular, elliptical or any other shape that best suits the intended application or the TES shape: for example, floating elements of rectangular shape provide a better contact with the internal wall of a TES of rectangular shape.

In one embodiment of the present invention, said suspension matrix may comprise overlapping floating elements having one and the same shape or more than one shape and one and the same size or more than one size, in this way offering a more effective heat barrier, as required by the tank geometry. For example, a plurality of square and circular wafers may be deployed in a rectangular tank with rounded corners, as the former provides a relatively better seal against the tank flat walls. Similarly, the latter performs relatively better at the rounded corners of the tank.

According to an embodiment, said suspension matrix may comprise more than one layer to form a matrix of overlapping layers, each layer comprising a plurality of overlapping floating elements, thereby, reducing the thermal diffusion from the hot to the cold fluid regions of the TES, which may take place though gaps formed between adjacent floating elements in the matrix.

According to a preferred embodiment of the present method, the material composition of plates or wafers, which form said plurality of overlapping floating elements having at least one flat face, may comprise at least two materials: one relatively denser core material, which is encapsulated in a thermally insulating material of relatively lower density.

Figure 1:
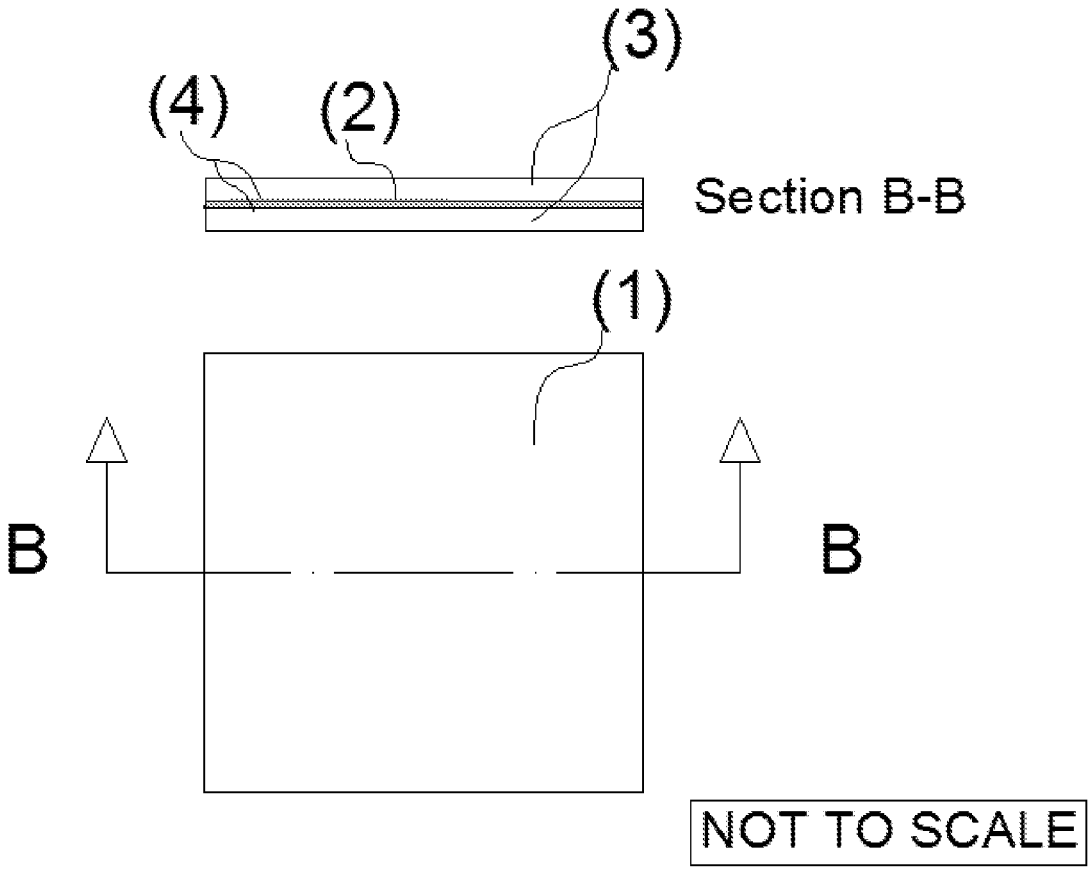
FIG. 1 shows a floating element design for domestic hot-water cylinders according to an embodiment of the present invention.

Referring to FIG. 1, a floating element, which is suitable to be used in hot-water storage according to an embodiment of the present method, is showed in top-down and in cross-sectional (B-B) views. The floating element, which specifically consists of a wafer (1), comprises a core material made of stainless-steel sheet (2), which is interposed between two layers of flexible ceramic paper (aluminosilicate) (3). A suitable binder (4) is applied on either side of the metal sheet, according to the manufacturer's instructions.

According to the present method, the density of the suspension matrix is designed to be of intermediate value between the density of the hot and cold fluid regime of the TES tank.

The suspension matrix density may be calculated from the following equation:

$$\rho_T = \frac{1}{V_T}\sum_{i=1}^{N}\rho_i V_i$$

where $\rho_T$, $V_T$ are respectively the floating element density and volume, i is the constituent material index and $\rho_i$, $V_i$ are the respective density and volume of each of the N materials composing the floating element. Depending on the hot water outlet temperature of the boiler, heat pump or solar system, and the temperature of the relatively cooler layer, the material thicknesses can be designed to achieve the required intermediate density value. For example, using the above equation, a flexible aluminosilicate sheet or ceramic paper ($\rho$=100 kg/m$^3$) and stainless-steel sheet ($\rho$=7650 kg/m$^3$) having a thickness of 4 mm and 0.5 mm respectively, yields a wafer density of 986 kg/m$^3$. This value of density leads to a matrix of elements suspended beneath a hot-water layer at 70° C. and above a relatively colder layer at 30° C.

The metal sheet thickness (2) (for example, stainless-steel or copper-sheet), should be less than 1 mm to ensure adequate wafer flexibility against any thermal contraction of the hot-water cylinder or thermal expansion of the floating elements.

Figure 2:
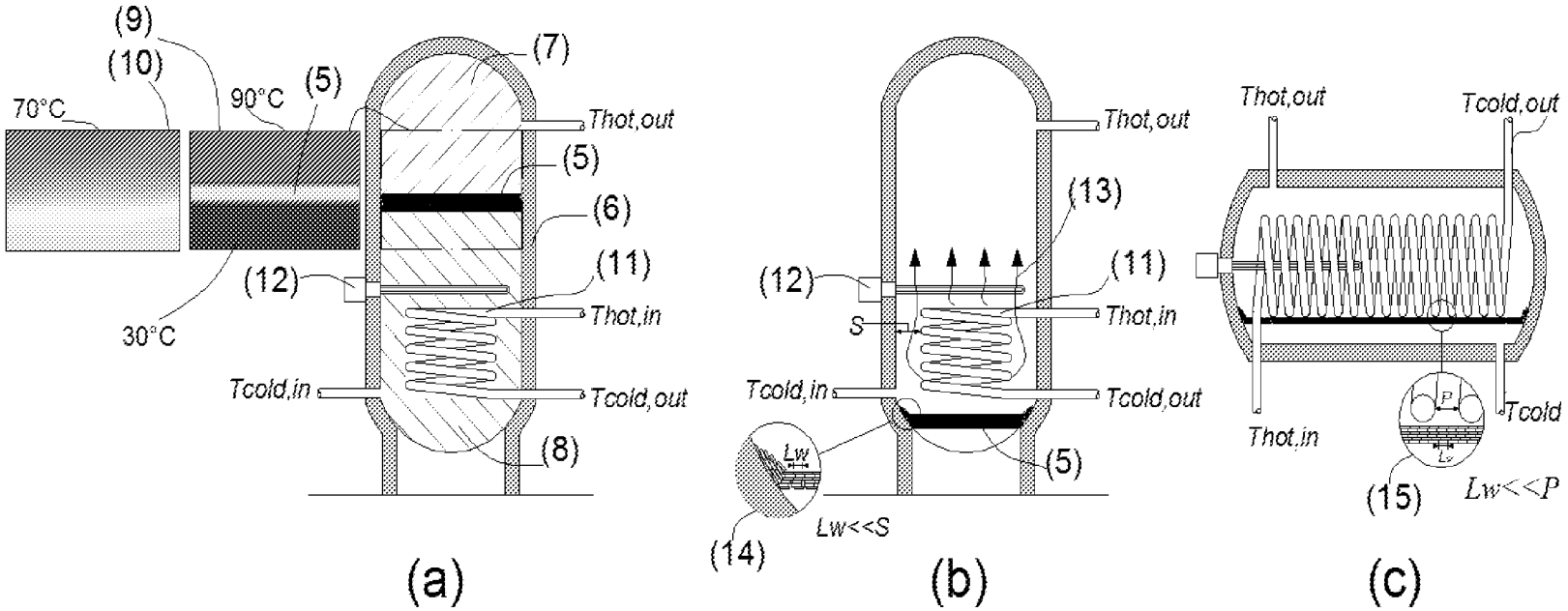
FIG. 2(*a*) is cross-sectional view of a vertical domestic hot-water cylinder carrying a thermally insulating wafer matrix according to an embodiment of the present method. The figure also presents Computational Fluid Dynamics results CFD with and without the use of the wafer matrix.

Referring to FIG. 2(*a*), a floating element matrix (5) according to an embodiment of the present method, used in a vertical hot-water cylinder (6), is shown. The floating element matrix (5), for example a wafer matrix, essentially limits the thermal diffusion from the hot-(7) to the cold-fluid (8). Numerical simulation results (9, 10) obtained using the Navier-Stokes equations coupled with the energy equation indicate a drop in the hot water temperature from 90° C. (for example, the hot-water temperature output of a central heating oil or gas burner) to 70° C. over a period of 3 hours, as a result of the thermal diffusion. Similarly, a hot water temperature of 65° C. (for example, the hot-water temperature output of a typical domestic heat pump) reduces to 56° C.

For both scenarios, if the cold water is supplied at a temperature between 5° C. and 10° C. and is mixed with hot water at a shower head or a tap to yield water at 45° C., then the use of the floating element matrix (5), which helps to attain a relatively higher water temperature in the tank, implies a reduced consumption of hot water by a factor of 1.8. In other words, by keeping the temperature of the hot water (7) in the cylinder (6) at a relatively higher temperature, the supply of hot water from the cylinder (6) is about half of that without using the suspension matrix (5) of floating elements.

Referring to FIG. 2(*b*), it is shown that in the presence of an ascending jet of heated fluid (13) generated by the electric heater (12) or by the boiler/heat-pump coil (11), the floating element matrix (5) sinks beneath the heat source (11 or 12). The floating element is specifically designed to have a length, Lw, which is about a third of the spacing, S, between the cylinder wall (6) and the coil (11), in this way preventing the element from getting jammed between the cylinder wall (6) and coil (11). As also shown in FIG. 2(*b*), the relatively small dimensions of the floating elements allow the suspension matrix (5) to reside along the curved walls (14) of the cylinder (6), thus overcoming any "dead" space effects, that is any unused space left between the barrier and the tank wall, as in the case of the divider plate method.

Referring to FIG. 2(*c*), a floating matrix according to another embodiment of the present method is shown. According to this embodiment, a specific floating element matrix suitable for utilization in TES systems including hardware and having curved walls, is developed. The floating element length, in this case, is specifically designed to be a third of the coil pitch, thereby preventing the element from getting jammed between the coil loops.

Figure 3:
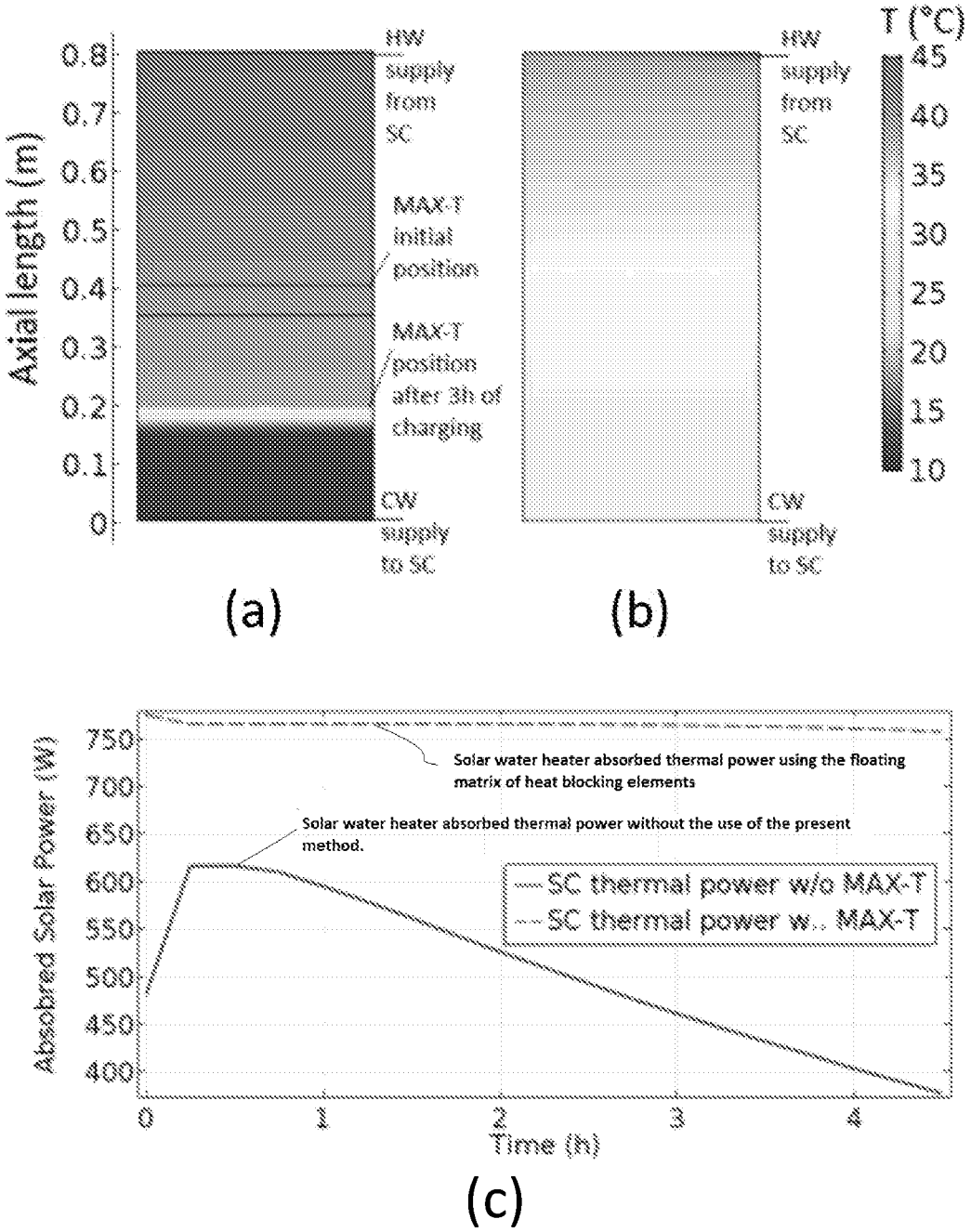
FIG. 3(*a*) is a simulated temperature field in a solar water heater tank that uses the present method, after 3 hours of solar-thermal charging.

With reference to FIG. 3(*a*), the simulated temperature field inside a solar water heater tank that utilizes the present method after 3 hours of solar-thermal charging is shown. Similarly, FIG. 3(*b*) illustrates the corresponding contour for the same tank, but this time without using the present method. The relatively higher temperature achieved in the former case is evident. FIG. 3(*c*) compares the calculated thermal power of the solar water heater with and without the use of the present method. The power of the solar water heater has increased by a factor of 1.5. The present method, which minimizes the heat diffusion from the hot to the colder water layer and, thereafter, the re-entry to and loss of this heat from the solar collector, has helped to nearly double the collection of heat by the solar collector.

According to different embodiments of the present method, the matrix of overlapping floating elements may be applicable to other TES fluids and working temperature. For instance, the method may be applied for molten salt storage fluids, comprising molten nitrate or higher temperature storage fluids, like, for example, molten chloride salts for a working temperature above 600° C. The material composition of the overlapping floating element used in this application may include, for example, a core material of copper or stainless-steel sheet, sandwiched between alumina paper to be suitable for hot-water energy storage TES.

Any industrial ceramic-to-metal binder that conforms to environmental and health and safety guidelines can be used for bonding the layers within the matrix. Other shapes may be adopted, for example, a thermally insulating compressible material casted into spheres having a denser core of, for example, metal.

Figure 4:
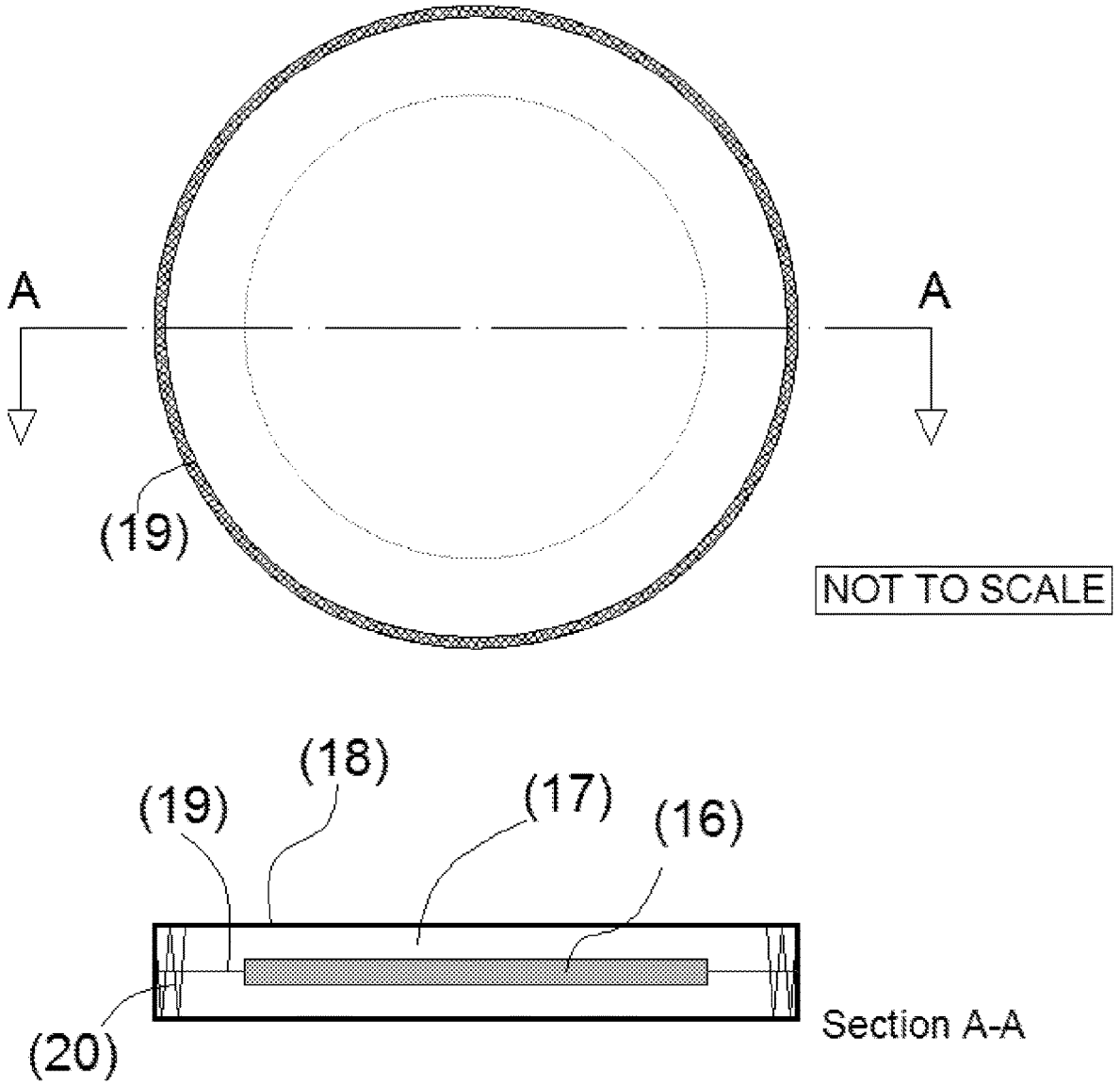
FIG. 4 is a top and cross-sectional view of a floating element suited for application in a solar salt TES according to an embodiment of the invention.

Referring to FIG. 4, a top-down and cross-sectional view of a floating element suitable to be used in a molten salt TES are shown. According to this embodiment, the floating element consists of a plate comprising an AISI-316 steel core (16) wrapped in mechanically needled ceramic (alumina-silicate) blanket (17). The layers are bonded using a ceramic-to-metal binder (18). The plate assembly is completed by stitching the ceramic layers around the circumference using alumina thread (19). A pore-sealing Boron Nitride (BN) coating (20) is applied on the outer layer of the plate. The BN layer also helps to reduce friction, thereby, facilitating the movement of one plate with respect to another.

To achieve a density value which is intermediate to that of the hot (560° C., $\rho$=1734 kg/m$^3$) and cold (300° C., $\rho$=1899 kg/m$^3$) solar salt, a metal sheet thickness of 4 mm and diameter of 250 mm must be used as core part of the floating element and an alumino-silicate blanket thickness and diameter of 25 mm and 300 mm respectively must be used as thermal insulation layer. These values yield a plate density of 1814 kg/m$^3$, which exactly an intermediate value between the hot and cold solar salt densities. These dimensions are given as an example only and clearly other dimensions, number of layers and materials can be considered more suitable for the intended application.

According to another embodiment of the present method, the matrix of floating elements is suited for relatively high temperature fluids comprising molten halide salts like:

- NaCl—$MgCl_2$ (63-37 mol %) for a temperature up to 700° C.,
- NaCl—KCl for a temperature up to 750° C.,
- LiF—$NdF_3$—NdO (27-63-10 wt %) for a temperature up to 1050° C.

Figure 5:
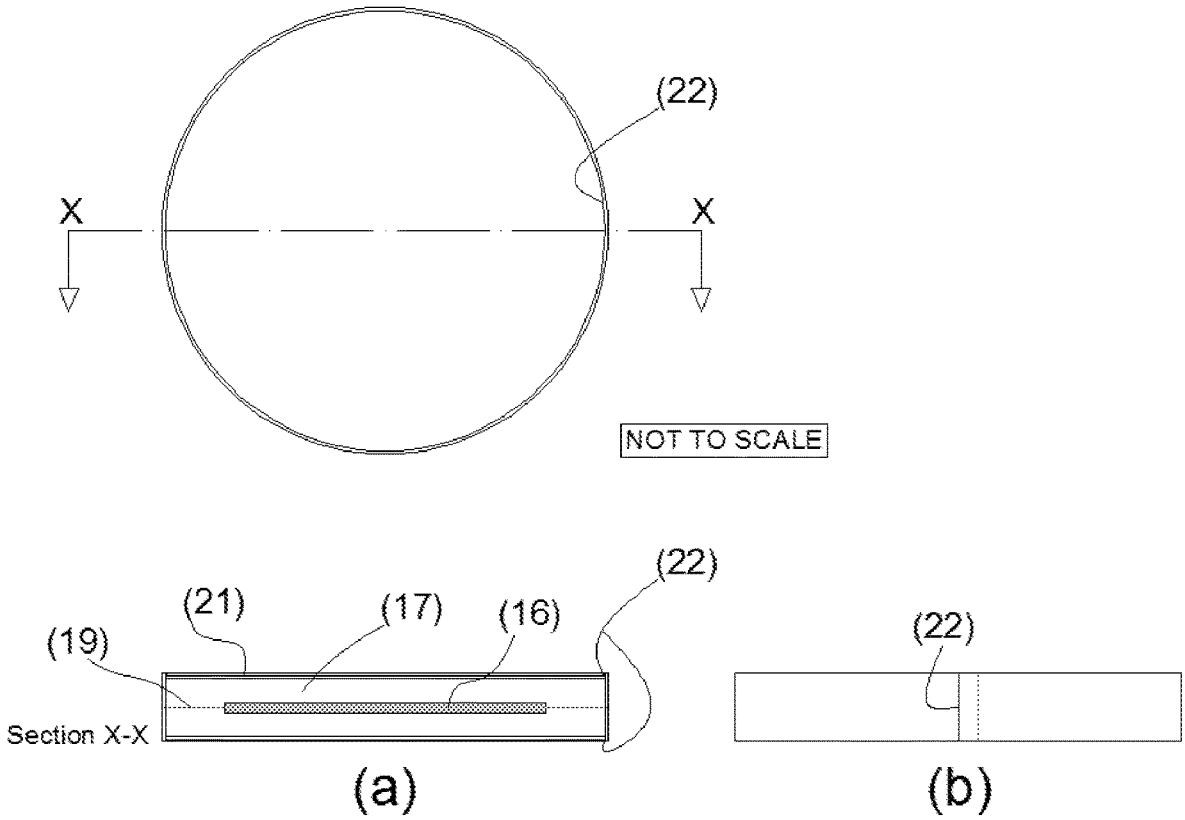
FIG. 5(*a*) is a top and cross-sectional view of a floating element design suitable for TES using molten chlorides, according to another embodiment of the present invention. In this example, the floating element comprises materials that permit a 30-year lifespan at a temperature of 1050° C.

Referring to FIG. 5*a*, the floating element consists of a core material (16) of AISI-316 or AISI-304 steel wrapped in mechanically needled ceramic blanket (17). A suitable ceramic-to-metal binder (19) is used to bond the materials, as this can facilitate the handling of the metal plate during the encapsulation. Tantalum sheet is used as the encapsulation shell (21), since this refractory metal has a corrosion rate of less than 0.03 mm/30 years and extending the lifetime to more than 30 years in application comprising molten halide salts.

The Tantalum sheet thickness must be in the range 0.07-0.125 mm. to allow for flexibility, preventing any thermal ratcheting effects of the TES. Laser welding may be used to create leak-tight Tantalum sheet joints (22), indicated in FIGS. 5(*a*) and 5(*b*). In this embodiment, the TES storage fluid should be under an Argon atmosphere to prevent corrosion of the Tantalum encapsulation.

According to a preferred embodiment of the present method, said overlapping floating elements have a size compatible with the introduction through a TES port hole during normal operating conditions.

According to another embodiment, said overlapping floating elements are simply introduced into the TES at the manufacturing stage.

Referring to FIG. 6(*a*), a typical schematic of a CSP TES (23), with back-up electric heaters (24), is shown. The TES fluid (25) includes a floating element matrix (26). As already noted, the floating elements allow for introduction into an operating CSP TES through a port hole (27). The floating element diameter or size is customizable, as required by the available port hole diameter, therefore the present method is applicable to a TES which is already in operation, and it is not required for the floating element matrix to be installed during the TES manufacturing stage.

In FIG. 6(*b*), the capacity of the floating matrix method to bypass the "dead" energy volume that results through the use of a divider plate, is illustrated. In fact, the floating elements will sink beneath the heat source when the cold fluid is heated.

FIG. 7 shows simulation results of thermal diffusion across (a) overlapping square wafers (elements with flat face) and (b) overlapping balls that help to demonstrate the improved heat blocking performance of the former over the latter. As per these illustrative simulations, FIG. 8 shows the relatively higher temperature that exists in the TES using the present method of overlapping elements that feature flat faces with respect to elements featuring no flat faces, such as spheres.

Finally, numerous modifications and variations can be made to the present invention, all of which fall within the scope of protection of the invention as defined in the appended claims.

The invention claimed is:

1. A method for maximizing the exergy of a Thermal energy storage (TES) tank, said method comprising the use of a thermally insulating suspension wherein said thermally insulating suspension comprises a matrix made by a plurality of overlapping floating elements, thus, providing an improved performance with respect to spherical pellets or, in general, elements that do not feature a flat face, wherein said overlapping floating elements comprise at least a first core material of relatively higher density and a second thermally insulating material of relatively lower density, encapsulating said first core material, and wherein said floating elements are characterized by one of the following:

(a) said first core material comprises AISI-316 stainless steel and said second thermally insulating material, wrapping said first core material, comprises mechanically-needled ceramic blanket layers for being used with molten salt, said blanket layers being stitched together around the edge by alumina thread, and said thermally insulating material being sprayed with a pore-sealing coating layer of Boron Nitride (BN), said coating layer being applied and cured on the outer surface of said thermally insulating material; or (b) said first core material comprises AISI-304 or AISI-316 stainless steel and said second thermally insulating material, wrapping said first core material, comprises mechanically needled alumina-silicate blanket layers, said floating element being encapsulated in a refractory metal, comprising Tantalum, having the purpose of providing a 30-year lifespan in said molten halide salts.

2. The method according to claim 1, wherein said overlapping floating elements comprise at least one of plates and wafers.

3. The method according to claim 1, wherein said overlapping floating elements are smaller than the diameter of a port hole of the TES tank and are suitable to be introduced through said port hole during normal operation activity or installed at the manufacturing stage.

4. The method according to claim 1, wherein said overlapping floating elements have a form comprising circular, rectangular elliptical or any other shape that best suits the form of the TES internal walls.

5. The method according to claim 1, wherein the TES tank contains hot and cold fluids and wherein a resultant density of the suspension matrix is designed to be of intermediate value between the densities of the hot and cold fluids of the TES.

6. The method according to claim 1, wherein said suspension matrix comprises a plurality of floating elements of mixed shape including spherical and ellipsoidal shapes) and size.

7. The method according to claim 1, wherein said TES tank is configured to work with higher temperature storage fluids including molten salts, said molten salts comprising molten nitrate, molten chlorides, a molten halides salt, or molten metals.

8. The method according to claim 1, wherein a ceramic-to-metal binder is used to bond said first and said second materials.

9. The method according to claim 1, wherein said TES tank is a single tank storage system being able to deliver the exergy levels of a two-tank storage system.

10. The method according to claim 1, wherein said TES tank belongs to a domestic hot-water cylinder, solar water heaters, buffer tanks or Concentrated Solar Power (CSP).

11. The method according to claim 6, wherein said mixed shape comprises at least one of spherical and ellipsoidal.

12. The method according to claim 1, wherein said floating elements are characterized in that said first core material comprises AISI-316 stainless steel and said second thermally insulating material, wrapping said first core material, comprises mechanically-needled ceramic blanket layers for being used with molten salt, said blanket layers being stitched together around the edge by alumina thread, and said thermally insulating material being sprayed with a pore-sealing coating layer of Boron Nitride (BN), said coating layer being applied and cured on the outer surface of said thermally insulating material.

13. The method according to claim 1, wherein said floating elements are characterized in that said first core material comprises AISI-304 or AISI-316 stainless steel and said second thermally insulating material, wrapping said first core material, comprises mechanically needled alumina-silicate blanket layers, said floating element being encapsulated in a refractory metal, comprising Tantalum, having the purpose of providing a 30-year lifespan in said molten halide salts.

* * * * *